US006028534A

United States Patent [19]

Ciglenec et al.

[11] Patent Number: 6,028,534

[45] Date of Patent: Feb. 22, 2000

[54] FORMATION DATA SENSING WITH DEPLOYED REMOTE SENSORS DURING WELL DRILLING

[75] Inventors: Reinhart Ciglenec; Jacques R. Tabanou, both of Houston; Remi Hutin, New Ulm, all of Tex.

[73] Assignee: Schlumberger Technology Corporation, Sugar Land, Tex.

[21] Appl. No.: 09/019,466

[22] Filed: Feb. 5, 1998

Related U.S. Application Data

[60] Provisional application No. 60/048,254, Jun. 2, 1997.

[51] Int. Cl.[7] ..... G01N 34/100

[52] U.S. Cl. ..... 340/856.2; 73/152.46; 166/117.5; 324/369; 340/856.3

[58] Field of Search ..... 324/329, 338, 324/356, 369; 340/853.4, 853.8, 856.1, 856.2, 856.3; 166/264, 50, 117.5, 117.6; 73/152.46

[56] References Cited

U.S. PATENT DOCUMENTS

| | | | |
|---|---|---|---|
| 3,934,468 | 1/1976 | Brieger . | |
| 4,167,111 | 9/1979 | Spuck, III | 73/155 |
| 4,745,802 | 5/1988 | Purfurst | 73/155 |
| 4,765,183 | 8/1988 | Coury | 73/154 |
| 4,893,505 | 1/1990 | Marsden et al. . | |
| 4,936,139 | 6/1990 | Zimmerman et al. . | |
| 5,165,274 | 11/1992 | Thiercelin . | |
| 5,207,104 | 5/1993 | Enderlin | 73/784 |
| 5,622,223 | 4/1997 | Vasquez . | |
| 5,706,892 | 1/1998 | Aeschbacher, Jr. et al. | 166/66 |
| 5,765,637 | 6/1998 | Dietle et al. . | |

*Primary Examiner*—Leslie Pascal
*Attorney, Agent, or Firm*—Steven L. Christian; James L. Jackson

[57] ABSTRACT

A method and apparatus for acquiring data representing formation parameters while drilling a wellbore is disclosed. A well is drilled with a drill string having a drill collar that is located above a drill bit. The drill collar includes a sonde section having transmitter/receiver electronics for transmitting a controlling signal having a frequency F and receiving data signals at a frequency 2F. The drill collar is adapted to embed one or more intelligent sensors into the formation laterally beyond the wall of the wellbore. The intelligent sensors have electronically dormant and active modes as commanded by the transmitter/receiver circuitry of the sonde and in the active mode have the capability for acquiring and storing selected formation data such as pressure, temperature, rock permeability, and the capability to transmit the stored data to the transmitter/receiver of the sonde for transmission thereby to surface equipment for processing and display to drilling personnel. As the well is being drilled the sonde electronics can be positioned in selected proximity with a remote sensor and, without tripping the drill string, formation data can be acquired and transmitted to the surface to enable drilling decisions based thereon.

20 Claims, 4 Drawing Sheets

FORMATION DATA SENSING WITH DEPLOYED REMOTE SENSORS DURING WELL DRILLING

CROSS-REFERENCE TO RELATED APPLICATIONS

This application claims priority to provisional application Ser. No. 60/048,254, filed Jun. 2, 1997, and incorporates such provisional application by reference herein.

BACKGROUND OF THE INVENTION

1. Field of the Invention

This invention relates generally to the drilling of deep wells such as for the production of petroleum products and more specifically concerns the acquisition of subsurface formation data such as formation pressure, formation permeability and the like while well drilling operations are in progress.

2. Description of the Related Art

In oil well description services, one part of the standard formation evaluation parameters is concerned with the reservoir pressure and the permeability of the reservoir rock. Present day operations obtain these parameters either through wireline logging via a "formation tester" tool or through drill stem tests. Both types of measurements are available in "open-hole" or "cased-hole" applications, and require a supplemental "trip", i.e., removing the drill string from the wellbore, running a formation tester into the wellbore to acquire the formation data and, after retrieving the formation tester, running the drill string back into the wellbore for further drilling. For the reason that "tripping the well" in this manner uses significant amounts of expensive rig time, it is typically done under circumstances where the formation data is absolutely needed or it is done when tripping of the drill string is done for a drill bit change or for other reasons.

During well drilling activities, the availability of reservoir formation data on a "real time" basis is a valuable asset. Real time formation pressure obtained while drilling will allow a drilling engineer or driller to make decisions concerning changes in drilling mud weight and composition as well as penetration parameters at a much earlier time to thus promote the safety aspects of drilling. The availability of real time reservoir formation data is also desirable to enable precision control of drill bit weight in relation to formation pressure changes and changes in permeability so that the drilling operation can be carried out at its maximum efficiency.

It is desirable therefore to provide a method and apparatus for well drilling that enable the acquisition of various formation data from a subsurface zone of interest while the drill string with its drill collars, drill bit and other drilling components are present within the well bore, thus eliminating or minimizing the need for tripping the well drilling equipment for the sole purpose of running formation testers into the wellbore for identification of these formation parameters. It is also desirable to provide a method and apparatus for well drilling that have the capability of acquiring formation data parameters such as pressure, temperature, and permeability, etc., while well drilling is in progress and to do so in connection with all known methods for borehole drilling.

To address these longfelt needs in the industry, it is a principal object of the present invention to provide a novel method and apparatus for acquiring subsurface formation data in connection with borehole drilling operations without necessitating tripping of the drill string from the well bore.

It is another object of the present invention to provide a novel method and apparatus for acquiring subsurface formation data during drilling operations.

It is an even further object of the present invention to provide a novel method and apparatus for acquiring subsurface formation data while drilling of a wellbore is in progress.

It is another object of the present invention to provide a novel method and apparatus for acquiring subsurface formation data by positioning a remote data sensor/transmitter within a subsurface formation adjacent a wellbore, selectively activating the remote data sensor for sensing, recording and transmitting formation data, and selectively receiving transmitted formation data by the drill stem system for display to drilling personnel.

It is an even further object of the present invention to provide such a novel method and apparatus by means of one or more remote "intelligent" formation data sensors that permits the transmission of formation data on a substantially real time basis to a data receiver in a drill collar or sonde that is a component of the drill string and has the capability of transmitting the received data through the drill string to surface equipment for display to drilling personnel.

SUMMARY OF THE INVENTION

The objects described above, as well as various objects and advantages, are achieved by a method and apparatus that contemplate the drilling of a well bore with a drill string having a drill collar with a drill bit connected thereto. The drill collar has a formation data receiver system and one or more remote data sensors which have the capability for sensing and recording formation data such as temperature, pressure, permeability, etc., and for transmitting signals representing the sensed data. When the drill collar is adjacent a selected subsurface formation such as a reservoir formation the drill collar apparatus is activated to position at least one data sensor within the subsurface formation outwardly beyond the wellbore for the sensing and transmission of formation data on command. The formation data signals transmitted by the data sensor are received by receiver circuitry onboard the drill collar and are further transmitted via the drill string to surface equipment such as the driller's console where the formation data is displayed. By monitoring the changes in the formation data sensed and displayed, drilling personnel are able to quickly and efficiently adjust downhole conditions such as drilling fluid weight and composition, bit weight, and other variables, to control the safety and efficiency of the drilling operation.

The intelligent data sensor can be positioned within the formation of interest by any suitable means. For example, a hydraulically energized ram can propel the sensor from the drill collar into the formation with sufficient hydraulic force for the sensor to penetrate the formation by a sufficient depth for sensing formation data. In the alternative, apparatus in the drill collar can be extended to drill outwardly or laterally into the formation, with the sensor then being positioned within the lateral bore by a sensor actuator. As a further alternative, a propellant energized system onboard the drill collar can be activated to fire the sensor with sufficient force to penetrate into the formation laterally beyond the wellbore. The sensor is appropriately encapsulated to withstand damage during its lateral installation into the formation, whatever the formation positioning method may be.

To enable its acquisition and transmission of formation data, the sensor is provided with an electrical power system, which may be a battery system or an inductive AC power coupling from a power cartridge onboard the drill collar. A micro-chip in the sensor assembly will enable the sensor circuit to perform data storage, handle the measurement process for the selected formation parameter or parameters and transmit the recorded data to the receiving circuitry of a formation data cartridge onboard the drill collar. The formation data signals are processed by formation data circuitry in the power cartridge to a form that can be sent to the surface via the drill string or by any other suitable data transmission system so that the data signals can be displayed to, and monitored by, well drilling personnel, typically at the drilling console of the drilling rig. Data changes downhole during the drilling procedure will become known, either on a real time basis or on a frequency that is selected by drilling personnel, thus enabling the drilling operation to be tailored to formation parameters that exist at any point in time.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part of this specification.

It is to be noted however, that the appended drawings illustrate only a typical embodiment of this invention and are therefore not to be considered limiting of its scope, for the invention may admit to other equally effective embodiments.

In the drawings:

FIG. 1 is a diagram of a drill collar positioned in a borehole and equipped with a data sensor/transmitter sonde section in accordance with the present invention;

FIG. 2 is a schematic illustration of the data sensor/transmitter sonde section of a drill collar having a hydraulically energized system for forcibly inserting a remote formation data sensor/transmitter from the borehole into a selected subsurface formation;

FIG. 3 is a diagram schematically representing a drill collar having a power cartridge therein being provided with electronic circuitry for receiving formation data signals from a remote formation data sensor/transmitter;

Figure 4:
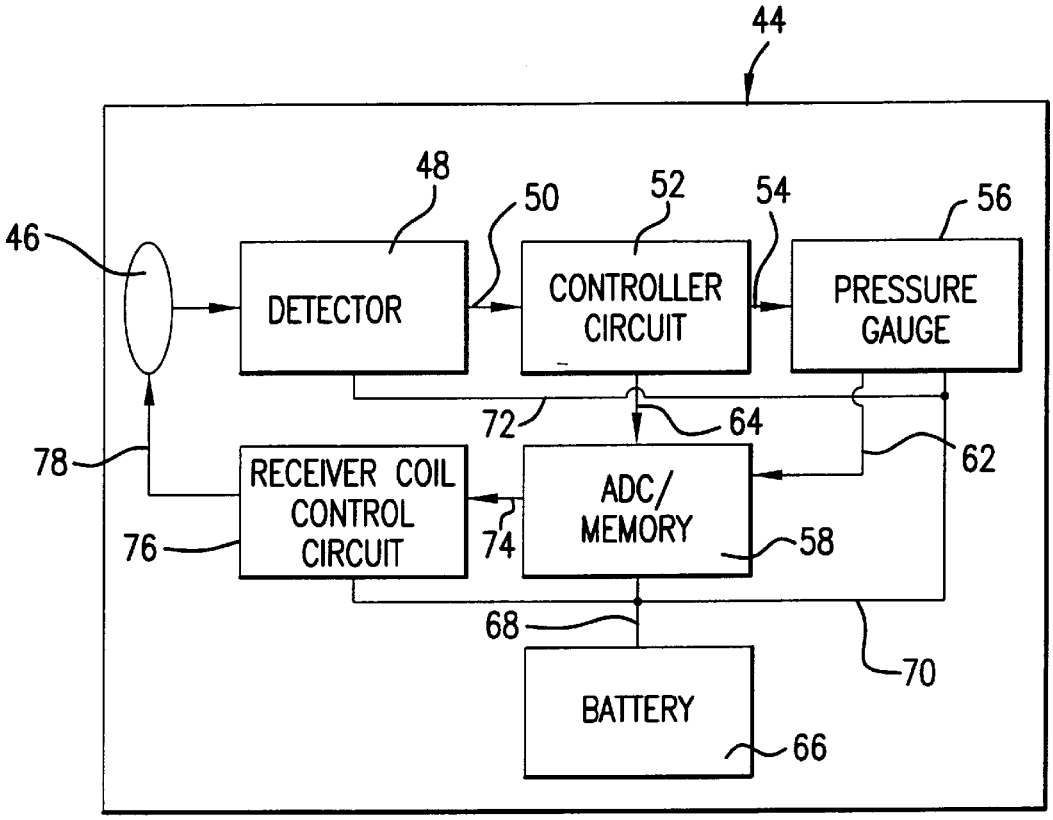
Figure 5:
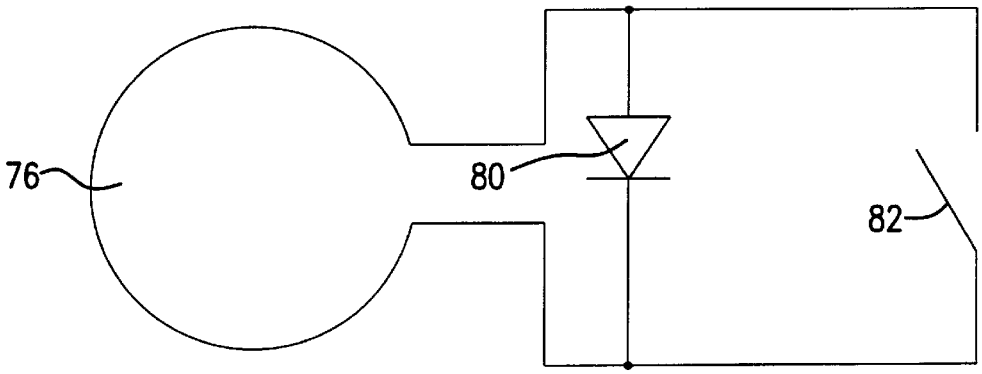
Figure 6:
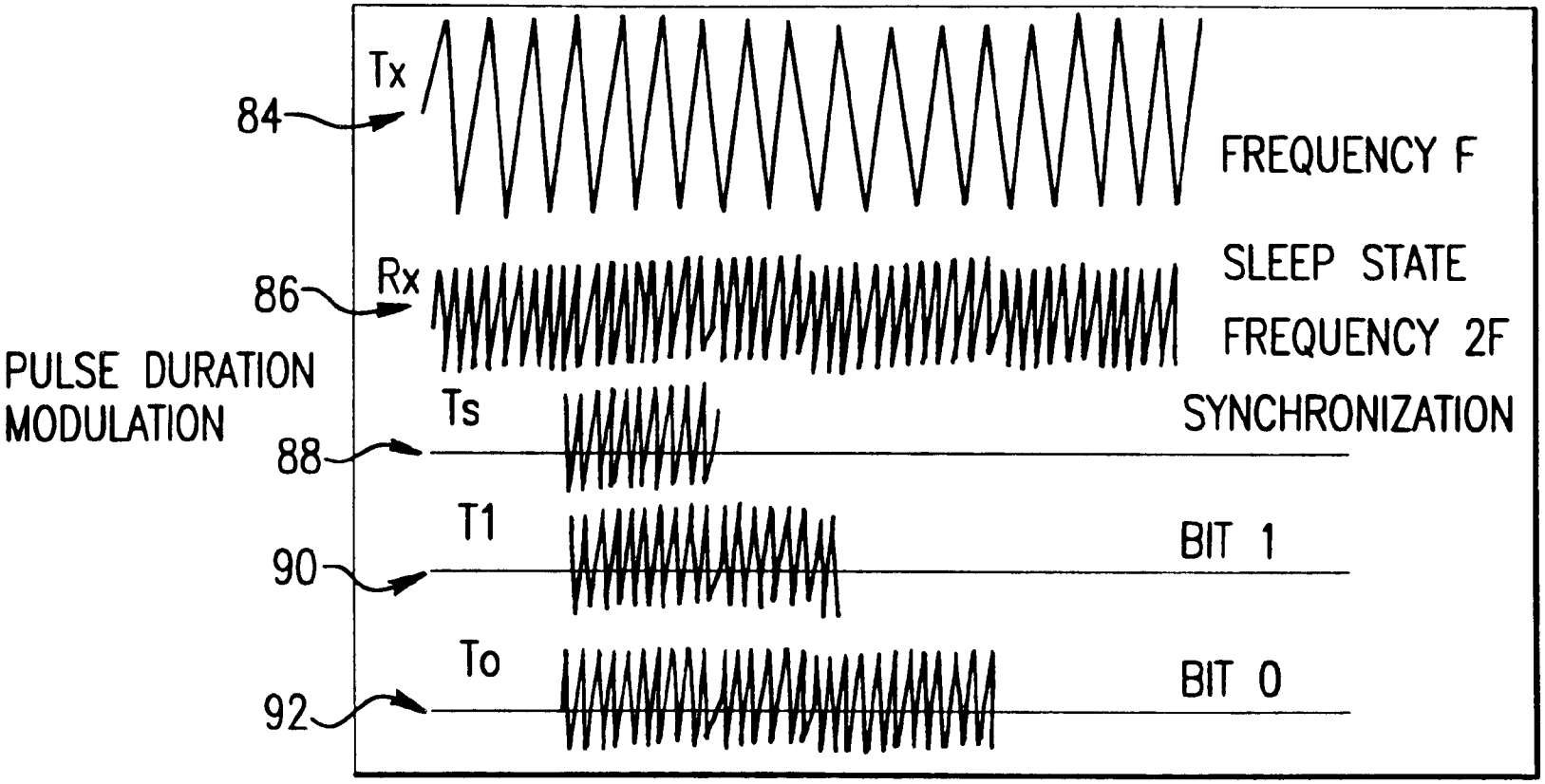

FIG. 4 is an electronic block diagram schematically showing a remote sensor which is positioned within a selected subsurface formation from the wellbore being drilled and which senses one or more formation data parameters such as pressure, temperature, and rock permeability, places the data in memory, and, as instructed, transmits the stored data to the circuitry of the power cartridge of the drill collar;

FIG. 5 is an electronic block diagram schematically illustrating the receiver coil circuit of the remote data sensor/transmitter; and FIG. 6 is a transmission timing diagram showing pulse duration modulation.

DESCRIPTION OF THE PREFERRED EMBODIMENTS

Figure 1:
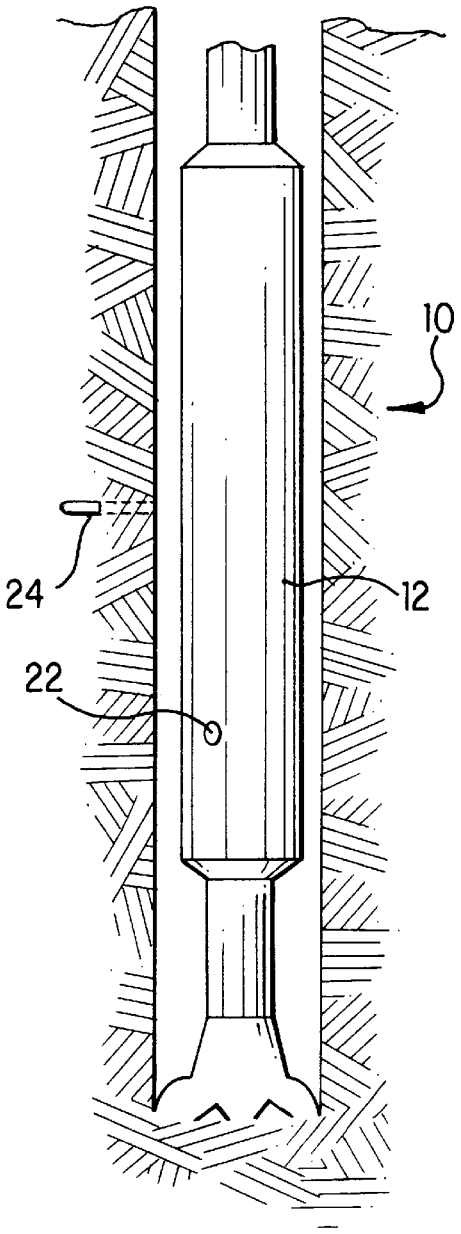
Figure 2:
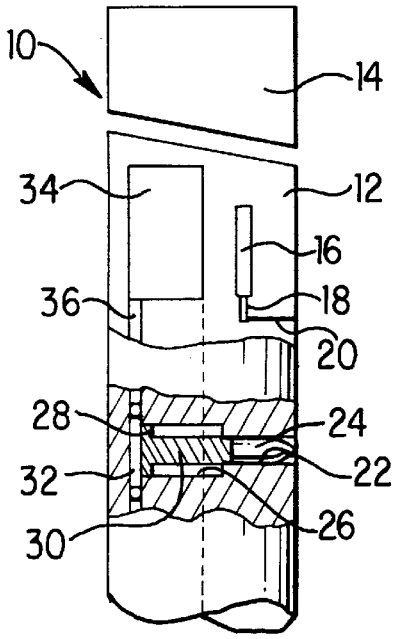
Figure 3:
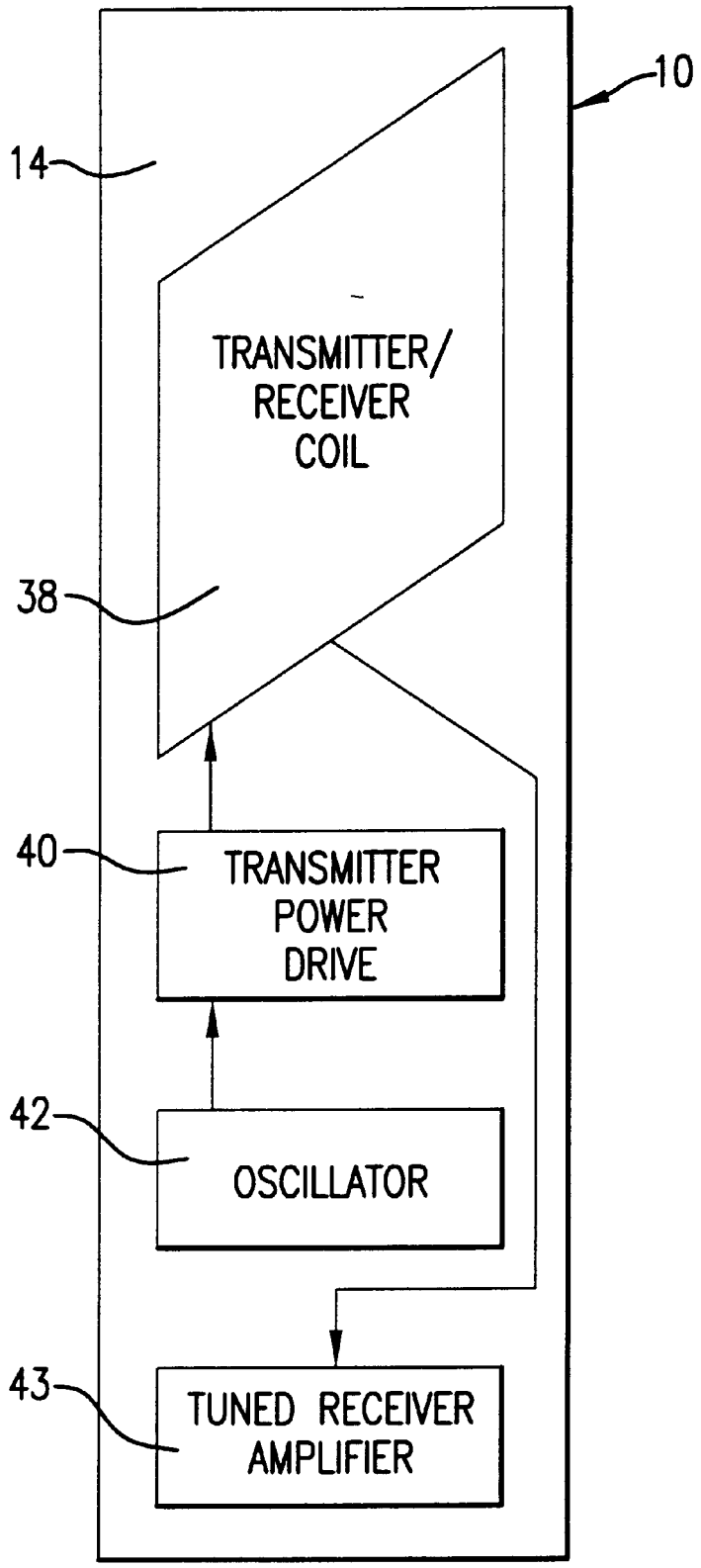

Referring now to the drawings and first to FIGS. 1–3, a drill collar being a component of a drill string for drilling a wellbore is shown generally at 10 and represents the preferred embodiment of the invention. The drill collar is provided with a sonde section 12 having a power cartridge 14 incorporating the transmitter/receiver circuitry of FIG. 3. The drill collar 10 is also provided with a pressure gauge 16 having its pressure sensor 18 exposed to borehole pressure via a drill collar passage 20. The pressure gauge senses ambient pressure at the depth of a selected subsurface formation and is used to verify pressure calibration of remote sensors. Electronic signals representing ambient wellbore pressure are transmitted via the pressure gauge 16 to the circuitry of the power cartridge 14 which, in turn, accomplishes pressure calibration of the remote sensor being deployed at that particular wellbore depth. The drill collar 10 is also provided with one or more remote sensor receptacles 22 each containing a remote sensor 24 for positioning within a selected subsurface formation of interest which is intersected by the wellbore being drilled.

The remote sensors 24 are encapsulated "intelligent" sensors which are moved from the drill collar to a position within the formation surrounding the borehole for sensing formation parameters such as pressure, temperature, rock permeability, porosity, conductivity, and dielectric constant, among others. The sensors are appropriately encapsulated in a sensor housing of sufficient structural integrity to withstand damage during movement from the drill collar into laterally embedded relation with the subsurface formation surrounding the wellbore. Those skilled in the art will appreciate that such lateral embedding movement need not be perpendicular to the borehole, but may be accomplished through numerous angles of attack into the desired formation position. Sensor deployment can be achieved by utilizing one or a combination of the following: (1) drilling into the borehole wall and placing the sensor into the formation; (2) punching/pressing the encapsulated sensors into the formation with a hydraulic press or mechanical penetration assembly; or (3) shooting the encapsulated sensors into the formation by utilizing propellant charges.

As shown in FIG. 2, a hydraulically energized ram 30 is employed to deploy the sensor 24 and to cause its penetration into the subsurface formation to a sufficient position outwardly from the borehole that it senses selected parameters of the formation. For sensor deployment, the drill collar is provided with an internal cylindrical bore 26 within which is positioned a piston element 28 having a ram 30 that is disposed in driving relation with the encapsulated remote intelligent sensor 24. The piston 28 is exposed to hydraulic pressure that is communicated to a piston chamber 32 from a hydraulic system 34 via a hydraulic supply passage 36. The hydraulic system is selectively activated by the power cartridge 14 so that the remote sensor can be calibrated with respect to ambient borehole pressure at formation depth, as described above, and can then be moved from the receptacle 22 into the formation beyond the borehole wall so that formation pressure parameters will be free from borehole effects.

Referring now to FIG. 3, the power cartridge 14 of the drill collar 10 incorporates at least one transmitter/receiver coil 38 having a transmitter power drive 40 in the form of a power amplifier having its frequency F determined by an oscillator 42. The drill collar sonde section is also provided with a tuned receiver amplifier 43 that is set to receive signals at a frequency 2F which will be transmitted to the sonde section of the drill collar by the "smart bullet" type remote sensor 24 as will be explained hereinbelow.

With reference to FIG. 4, the electronic circuitry of the remote "smart sensor" is shown by a block diagram generally at 44 and includes at least one transmitter/receiver coil 46, or RF antenna, with the receiver thereof providing an output 50 from a detector 48 to a controller circuit 52. The controller circuit is provided with one of its controlling outputs 54 being fed to a pressure gauge 56 so that gauge output signals will be conducted to an analog-to-digital converter ("ADC")/memory 58, which receives signals from the pressure gauge via a conductor 62 and also receives control signals from the controller circuit 52 via a conductor 64. A battery 66 is provided within the remote sensor circuitry 44 and is coupled with the various circuitry components of the sensor by power conductors 68, 70 and 72. A memory output 74 of the ADC/memory circuit 58 is fed to a receiver coil control circuit 76. The receiver coil control circuit 76 functions as a driver circuit via conductor 78 for transmitter/receiver coil 46 to transmit data to sonde 12.

Referring now to FIG. 5 a low threshold diode 80 is connected across the Rx coil control circuit 76. Under normal conditions, and especially in the dormant or "sleep" mode, the electronic switch 82 is open, minimizing power consumption. When the receiver coil control circuit 76 becomes activated by the drill collar's transmitted electromagnetic field, a voltage and a current is induced in the receiver coil control circuit. At this point, however, the diode 80 will allow the current to flow only in one direction. This non-linearity changes the fundamental frequency F of the induced current shown at 84 in FIG. 6 into a current having the fundamental frequency 2F, i.e., twice the frequency of the electromagnetic wave 84 as shown at 86.

Throughout the complete transmission sequence, the transmitter/receiver coil 38, shown in FIG. 3, is also used as a receiver and is connected to a receiver amplifier 43 which is tuned at the 2F frequency. When the amplitude of the received signal is a maximum, the remote sensor 24 is located in close proximity for optimum transmission between drill collar and remote sensor.

Operation

Assuming that the intelligent remote sensor, or "smart bullet" as it is also called, is in place inside the formation to be monitored, the sequence in which the transmission and the acquisition electronics function in conjunction with drilling operations is as follows:

The drill collar with its acquisition sensors is positioned in close proximity of the remote sensor 24. An electromagnetic wave at a frequency F, as shown at 84 in FIG. 6, is transmitted from the drill collar transmitter/receiver coil 38 to 'switch on' the remote sensor, also referred to as the target, and to induce the sensor to send back an identifying coded signal. The electromagnetic wave initiates the remote sensor's electronics to go into the acquisition and transmission mode, and pressure data and other data representing selected formation parameters, as well as the sensor's identification code, are obtained at the remote sensor's level. The presence of the target, i.e., the remote sensor, is detected by the reflected wave scattered back from the target at a frequency of 2F as shown at 86 in the transmission timing diagram of FIG. 6. At the same time pressure gauge data (pressure and temperature) and other selected formation parameters are acquired and the electronics of the remote sensor convert the data into one or more serial digital signals. This digital signal or signals, as the case may be, is transmitted from the remote sensor back to the drill collar via the transmitter/receiver coil 46. This is achieved by synchronizing and coding each individual bit of data into a specific time sequence during which the scattered frequency will be switched between F and 2F. Data acquisition and transmission is terminated after stable pressure and temperature readings have been obtained and successfully transmitted to the on-board circuitry of the drill collar 10.

Whenever the sequence above is initiated, the transmitter/receiver coil 38 located within the drill collar or the sonde section of the drill collar is powered by the transmitter power drive or amplifier 40. An electromagnetic wave is transmitted from the drill collar at a frequency F determined by the oscillator 42, as indicated in the timing diagram of FIG. 6 at 84. The frequency F can be selected within the range from 100 KHz up to 500 MHz. As soon as the target comes within the zone of influence of the collar transmitter, the receiver coil 46 located within the smart bullet will radiate back an electromagnetic wave at twice the original frequency by means of the receiver coil control circuit 76 and the transmitter/receiver coil 46.

In contrast to present day operations, the present invention makes pressure data and other formation parameters available while drilling, and, as such, allows well drilling personnel to make decisions concerning drilling mud weight and composition as well as other parameters at a much earlier time in the drilling process without necessitating the tripping of the drill string for the purpose of running a formation tester instrument. The present invention requires very little time to perform the actual formation measurements; once a remote sensor is deployed, data can be obtained while drilling, a feature that is not possible according to known well drilling techniques.

Time dependent pressure monitoring of penetrated wellbore formations can also be achieved as long as pressure data from the pressure sensor 18 is available. This feature is dependent of course on the communication link between the transmitter/receiver circuitry within the power cartridge of the drill collar and any deployed intelligent remote sensors.

The remote sensor output can also be read with wireline logging tools during standard logging operations. This feature of the invention permits varying data conditions of the subsurface formation to be acquired by the electronics of logging tools in addition to the real time formation data that is now obtainable from the formation while drilling.

By positioning the intelligent remote sensors 24 beyond the immediate borehole environment, at least in the initial data acquisition period there will be no borehole effects on the pressure measurements taken. As no liquid movement is necessary to obtain formation pressures with in-situ sensors, it will be possible to measure formation pressure in non-permeable rocks. Those skilled in the art will appreciate that the present invention is equally adaptable for measurement of several formation parameters, such as permeability, conductivity, dielectric constant, rock strength, and others, and is not limited to formation pressure measurement.

Furthermore, it is contemplated by and within the scope of the present invention that the remote sensors, once deployed, may provide a source of formation data for a substantial period of time. For this purpose, it is necessary that the positions of the respective sensors be identifiable. Thus, in one embodiment, the remote sensors will contain radioactive "pip-tags" that are identifiable by a gamma ray sensing tool or sonde together with a gyroscopic device in a tool string that enhances the location and individual spatial identification of each deployed sensor in the formation.

In view of the foregoing it is evident that the present invention is well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

What is claimed is:

1. A method for acquiring data from a subsurface earth formation during drilling operations, comprising:

(a) drilling a wellbore with a drill string having a drill collar with a drill bit connected thereto, the drill collar having a data sensor adapted for remote positioning within a selected subsurface formation intersected by the wellbore;

(b) moving the data sensor from the drill collar into a selected subsurface formation for sensing of formation data thereby;

(c) transmitting signals representative of the formation data from the data sensor; and (d) receiving the transmitted formation data signals to determine various formation parameters.

2. The method of claim 1, wherein the transmitted formation data signals are received by a data receiver disposed in the drill collar during drilling of the wellbore.

3. The method of claim 1, wherein the transmitted formation data signals are received by a wireline tool during a well logging operation commenced during a well trip.

4. The method of claim 1, wherein the step of moving the data sensor comprises:

(a) drilling a sensor bore into the well bore wall; and (b) placing the data sensor within the sensor bore.

5. The method of claim 1, wherein the step of moving the data sensor comprises applying sufficient force to the data sensor from the drill collar to cause the data sensor to penetrate the subsurface earth formation.

6. The method of claim 5, wherein the step of applying force to the data sensor comprises using hydraulic power applied from the drill collar.

7. The method of claim 5, wherein the step of applying force to the data sensor comprises firing the data sensor from the drill collar into the subsurface earth formation as a propellant actuated projectile using a propellant charges ignited within the drill collar.

8. A method for substantially continuously acquiring data from a location within a subsurface earth formation during well drilling operations, comprising the steps of:

(a) drilling a wellbore with a drill string having a drill collar connected therein and having a drill bit that is rotated by the drill string against the earth formation, the drill collar having formation data receiving means and having formation data sensing means being movable relative to the drill collar from a retracted position within the drill collar to a deployed position in data sensing engagement within the subsurface earth formation beyond the wellbore, the data sensing means being adapted to sense formation data and provide a formation data output that is receivable by the formation data receiving means;

(b) moving the formation data sensing means from the retracted position to the deployed position within the subsurface formation beyond the borehole for data sensing engagement with the subsurface formation;

(c) transmitting signals from the data sensing means representative of the formation data sensed thereby; and (d) receiving the transmitted signals by the formation data receiving means to determine various formation parameters.

9. The method of claim 8, wherein the signal transmitting and receiving steps take place while the drill collar is being moved within the borehole during a drilling operation.

10. The method of claim 8, wherein the signal transmitting step takes place while the drill collar is being rotated within the borehole during a drilling operation.

11. The method of claim 8, wherein the signal receiving step takes place while the drill collar is static within the borehole being drilled.

12. The method of claim 8, wherein the deployed position is defined by moving the formation data sensing means perpendicularly to the borehole through the subsurface formation.

13. A method for substantially continuously acquiring data from a location within a subsurface earth formation during well drilling operations, comprising the steps of:

(a) drilling a wellbore with a drill string having a drill collar connected therein and having a drill bit that is rotated by the drill string against the earth formation, the drill collar having formation data receiving means and having formation data sensing means being movable relative to the drill collar from a retracted position within the drill collar to a deployed position in data sensing engagement within the subsurface earth formation beyond the wellbore, the data sensing means being adapted to sense formation data and provide a formation data output that is receivable by the formation data receiving means;

(b) interrupting wellbore drilling operations;

(c) moving the formation data sensing means from the retracted position to the deployed position within the subsurface formation beyond the borehole for data sensing engagement with the subsurface formation;

(d) continuing wellbore drilling operations;

(e) transmitting signals from the formation data sensing means representative of the formation data sensed thereby;

(f) moving the drill collar to position the formation data receiving means in proximity with the formation data sensing means; and (g) receiving the transmitted signals by the formation data receiving means to determine various formation parameters.

14. A method for measuring formation parameters during well drilling operations, comprising the steps of:

(a) drilling a wellbore in a subsurface earth formation with a drill string having a drill collar and having a drill bit, the drill collar having a sonde that includes sensing means movable from a retracted position within the sonde to a deployed position within the subsurface earth formation beyond the wellbore, the sensing means having electronic circuitry therein adapted to sense selected formation parameters and provide data output signals representing the sensed formation parameters, the sonde further having receiving means for receiving the data output signals;

(b) with the drill collar and sonde at a desired location relative to a subsurface formation of interest, moving the sensing means from a retracted position within the sonde to a deployed position within the subsurface formation of interest outwardly of the wellbore;

(c) electronically activating the electronic circuitry of the sensing means, causing the sensing means to sense the selected formation parameters;

(d) causing the sensing means to transmit data output signals representative of the sensed formation parameters; and (e) receiving the data output signals from the sensing means with the receiving means.

15. A method for sensing formation data during well drilling operations, comprising the steps of:

(a) positioning within a subsurface earth formation intersected by a wellbore at least one remote data sensor for sensing at least one formation data parameter and for transmitting at least one data signal representing the one formation data parameter;

(b) transmitting an activation signal to the remote data sensor to induce the sensor to sense the one formation parameter and transmit at least one data signal representing the one formation parameter; and (c) receiving the one data signal from the one remote data sensor during drilling of the wellbore.

16. An apparatus for acquiring selected data from a subsurface formation intersected by a wellbore during drilling of the wellbore, comprising:

(a) a drill collar being connected in a drill string having a drill bit at the lower end thereof;

(b) a sonde located within the drill collar and having electronic circuitry for transmitting and for receiving signals, said sonde having a sensor receptacle;

(c) a remote intelligent sensor located within the sensor receptacle of said sonde and having electronic sensor circuitry for sensing the selected data, and having electric circuitry for receiving the signals transmitted by the transmitting and receiving circuitry of said sonde and for transmitting formation data signals to the transmitting and receiving circuitry of said sonde; and (d) means within said sonde for laterally deploying said remote intelligent sensor from the sensor receptacle to a location within the subsurface formation beyond the wellbore.

17. The apparatus of claim 16, wherein said laterally deploying means of said remote intelligent sensor comprises a hydraulic actuator system within said sonde having a hydraulically energized deployment ram disposed for engagement with said remote intelligent sensor, the hydraulic actuator system being selectively controlled by said transmitting and receiving circuitry of said sonde for hydraulically moving said remote intelligent sensor from the sensor receptacle to an embedded position within the subsurface formation and sufficiently remote from the wellbore to sense the selected formation data.

18. The apparatus of claim 16, wherein said sonde includes a pressure gauge and a sensor calibration system for calibrating said remote intelligent sensor with respect to ambient borehole pressure at the depth of the selected subsurface formation within which said remote intelligent sensor is to be deployed.

19. The apparatus of claim 16, wherein:

(a) the transmitting and receiving circuitry of said sonde is adapted for transmitting command signals at a frequency F and for receiving data signals at a frequency 2F; and (b) the receiving and transmitting circuitry of said remote intelligent sensor is adapted for receiving command signals at a frequency F and for transmitting data signals at a frequency 2F.

20. The apparatus of claim 16, wherein:

(a) said remote intelligent sensor includes an electronic memory circuit for acquiring formation data over a period of time; and (b) the data sensing circuitry of said remote intelligent sensor includes means for inputting formation data into said electronic memory circuit, and a coil control circuit receiving the output of said electronic memory circuit for activating the receiving and transmitting circuitry of said remote intelligent sensor for transmitting signals representative of the sensed formation data from the deployed location of said remote intelligent sensor to the transmitting and receiving circuitry of said sonde.

* * * * *